United States Patent [19]

Noerholm

[11] 4,331,947

[45] * May 25, 1982

[54] ELECTRIC SAFETY FUSE

[75] Inventor: Olav Noerholm, Helsinge, Denmark

[73] Assignee: Aktieselkabet Laur. Knudsen Nordisk Electricitets, Copenhagen, Denmark

[ * ] Notice: The portion of the term of this patent subsequent to Jan. 20, 1998, has been disclaimed.

[21] Appl. No.: 140,423

[22] Filed: Apr. 15, 1980

Related U.S. Application Data

[63] Continuation of Ser. No. 907,354, May 18, 1978, Pat. No. 4,246,563.

[30] Foreign Application Priority Data

Mar. 10, 1978 [DK] Denmark ..... 1097/78
May 28, 1977 [GB] United Kingdom ..... 22659/77

[51] Int. Cl.[3] ..... H01H 85/04
[52] U.S. Cl. ..... 337/159; 337/296
[58] Field of Search ..... 29/623; 337/276, 278, 337/297, 159–164, 166, 290, 295, 296; 38/308

[56] References Cited

U.S. PATENT DOCUMENTS

| | | | |
|---|---|---|---|
| 3,271,544 | 9/1966 | Ragan | 337/297 |
| 3,368,919 | 2/1968 | Casale et al. | 338/308 |
| 3,538,479 | 11/1970 | Fister | 337/166 |
| 3,585,556 | 6/1971 | Hingorany | 337/297 |
| 3,887,893 | 6/1975 | Brandt et al. | 337/297 |
| 4,246,563 | 1/1981 | Noerholm | 337/296 |

*Primary Examiner*—William H. Beha, Jr.
*Attorney, Agent, or Firm*—Kenyon & Kenyon

[57] ABSTRACT

A laminated electric safety fuse which is built up laminated design consisting of various conductive materials which are embedded on an electrically insulating supporting member. The supporting member comprises one or more layers of electrically insulating material, a predominant part of which is a material having good thermal conductivity.

In this design a narrowing effect is obtained which is up to 10 times larger than in known fuses, without sacrificing the current-carrying capacity of the non-narrowed parts of the fuse element.

The various layers from which the safety fuse is built up can consist of materials with different electric conductivity, providing a new variable for obtaining an increased narrowing effect. The individual layers can be built up as films, e.g. by evaporative deposition.

9 Claims, 10 Drawing Figures

ELECTRIC SAFETY FUSE

Figure 1:
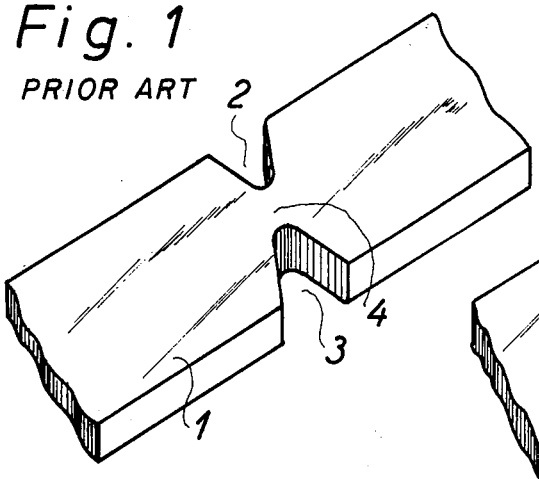
Fig. 1 PRIOR ART

This is a continuation of application Ser. No. 907,354, filed on May 18, 1978, now U.S. Pat. No. 4,246,563, issued Jan. 20, 1981.

The invention relates to an electric safety fuse of the type where the fuse element or fuse elements are surrounded by an arc suppression material, and where the fuse element or fuse elements are made up of one or more materials, the places of break usually being defined by reduced current-carrying cross sectional area. The arc suppression material usually consists of quartz sand ($SiO_2$), but it also is possible to apply other materials.

The purpose of the invention is to provide a fuse and a procedure for making it which will allow the manufacture of fuses which are distinguished by:

higher rated output unit volume and/or more compact design and/or faster fuse characteristic than is possible with the technology known today.

It is generally known to create a mechanical reduction of the current-carrying cross section of the fuse element by means of width reduction and/or thickness reduction. U.S. Pat. Nos. 3,543,209 and 3,543,210 show fuses where both principles have been applied in combination.

It is also known that it is prerequisite for obtaining a fast fuse characteristic that the area reduction ratio be large—e.g. greater than 1:10, and finally it is known that this reduction must be made in such a way that the current carrying capacity for the non-narrowed parts of the fuse element is maintained.

It is a feature of the fuse according to the invention that each fuse element is built up as a laminated construction comprising at least one electrically conductive layer including a fusible layer in intimate contact with a support member having one or more layers of electrically insulating material, the predominant material of the support member being heat conductive. In addition, a reduction of the electrical conductivity may be obtained by a suitable choice of material in the break region. In such a fuse it is possible to obtain a narrowing effect which is many times larger (5–10) than in the technology applied so far, without sacrificing the current-carrying capacity of the non-narrowed parts of the fuse element. The reason for this is partly that very thin layers can be used in the place of break because of the supporting material and partly that by using suitable materials it is possible to work with reduction in the electric conductivity as a third variable.

Furthermore, the places of break will be effectively cooled by the supporting material or the supporting element, which according to the invention will be in intimate contact with the electrically conducting part of the fuse element, and therefore the fuse element can be loaded with substantially higher current densities than is possible with the technology known so far.

It is a feature of one embodiment of the fuse that the electrically insulating supporting material consists of two or more layers with different heat conductivity.

What is achieved by this feature is that the thermal time constant for the surface layer of the supporting member on which the electrically conducting—and thus heat generating—element is built up can be varied, and consequently it will be possible to construct fuses with quite special fuse characteristics.

By selecting the thickness of the various layers and their heat conductivity it is furthermore possible to achieve a thermal time constant adapted to different combinations of current and time.

If a thin layer of electrically insulating material of low thermal conductivity is placed at the place of break between the fusible layer and the thermally conductive supporting material, such a layer will serve as a heat barrier in conjunction with heavy overloads and the result of this will therefore be that the fuse will break in such cases. In conjunction with continuous high load the heat will be conducted away through the heat conductive layer, which is obtained by means of a suitable dimensioning of the thickness and heat conductivity of said layer. Thus, it will be possible through dimensioning of the various layers in the supporting member to make fuses with different characteristics.

It is a feature of a second embodiment that the electrically conducting part of the fuse element consists of several layers which have been selected individually on the basis of knowledge of exactly the specific properties of the materials which are desirable in the individual areas of the fuse element. Also here it is possible, of course, that each individual layer does not cover the entire extent of the element.

In the actual place of break, for instance, one may want to use metals or alloys which have a well-defined and reasonably high electric conductivity, but what is especially wanted is that they are heat resisting. Silver and aluminum and their alloys are suitable. In the areas adjacent to the places of break and in particular in the thicker and more material-consuming areas more importance is attached to cost, and therefore copper or aluminum are of current interest. As a top covering layer one could again apply a material which protects by being heat resisting, and therefore aluminum and various ceramic materials may be selected.

It is therefore a feature of a third embodiment of the fuse that it is fully or partly coated with a covering layer of a resistant material.

The invention also relates to a procedure for the manufacture of the fuse, which comprises putting on or applying the individual layers of electrically conductive materials to the primarily heat conducting, electrically insulating supporting material, which can be, for example, aluminum oxide or beryllium oxide, by means of evaporative deposition, sputtering, silk screen printing (serigraphy), galvanic application, chemical precipitation or similar known procedure of lamination or combinations of these.

Figure 2:
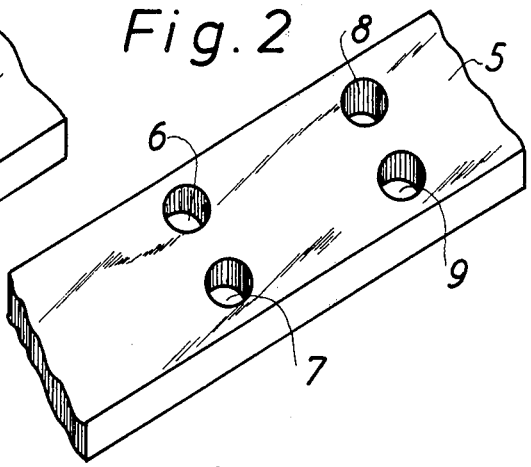
PRIOR ART Fig. 2
Figure 3:
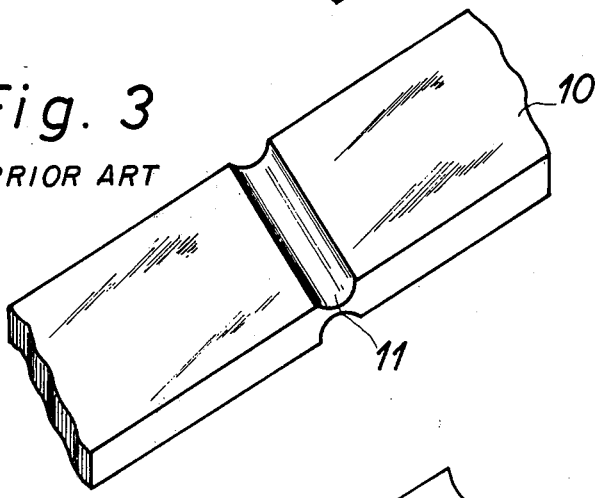
Fig. 3 PRIOR ART

The invention will be explained in further detail with reference to the drawing, wherein FIG. 1 shows in perspective a conventional fuse element with width reduction in the place of break, FIG. 2 shows in perspective another example of a conventional fuse element, FIG. 3 shows in perspective a conventional fuse element with thickness reduction in the place of break, and FIGS. 4–10 show in perspective a number of embodiments of fuses according to the invention.

All of the fuse elements and fuses are shown in exaggerated thickness.

FIG. 1 shows a known fuse element consisting of a metal strip 1 with notches 2 and 3 which gives a width reduction for the formation of a place of break 4.

FIG. 2 shows another known fuse element consisting of a metal strip 5, in which holes 6, 7, 8 and 9 have been punched out. The cross sections in which the holes have been placed will be the places of break because of the reduction of the cross section.

FIG. 3 shows a third known fuse element consisting of a metal strip 10, which has been pressed between cylindrical jaws, so that the thickness has been reduced in order to form a place of break 11.

Figure 4:
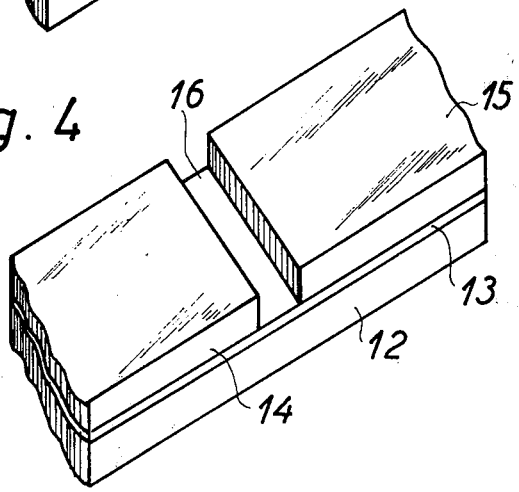

FIG. 4 shows a fuse according to the invention, which has been built up on a supporting member 12 consisting of a layer of heat conducting, electrically insulating material. It ought to be stressed here that everywhere in the present description and claims it is stated as if the fuse element is oriented in such a way that the supporting member 12 is at the bottom. This has been done merely for the sake of convenience, as it is of course unimportant how the fuse is oriented.

The individual layers are also illustrated as plane layers, but the layers can be formed, of course, in non-planar shapes. The supporting member comprises a layer of an electric insulator made of reasonably arc resistant, primarily thermally well-conducting material, e.g. ceramic materials containing quartz, aluminum oxide and/or beryllium oxide. On the supporting member 12 a fusible layer 13 of electrically conductive material has been laid by means of a known lamination technology, and on top of this layer 13 additional electrically conductive layers 14 and 15 have been laid, which are separated by a groove 16, so that a place of break is formed with a thickness reduction corresponding to that of the fuse element shown in FIG. 3.

Figure 5:
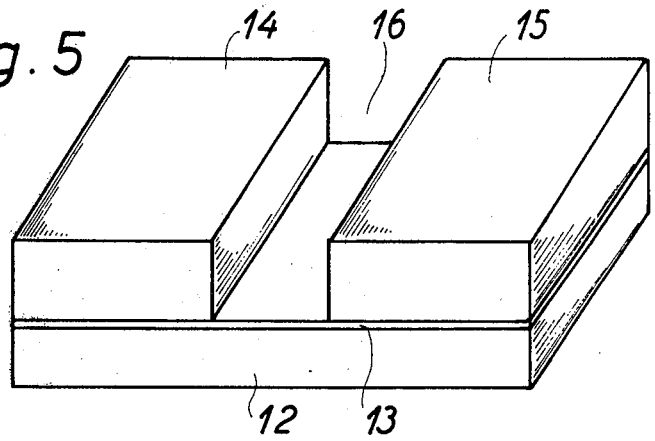
Figure 6:
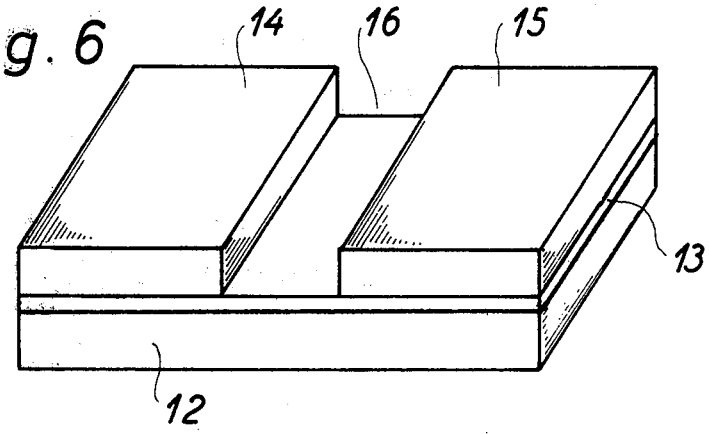
Figure 7:
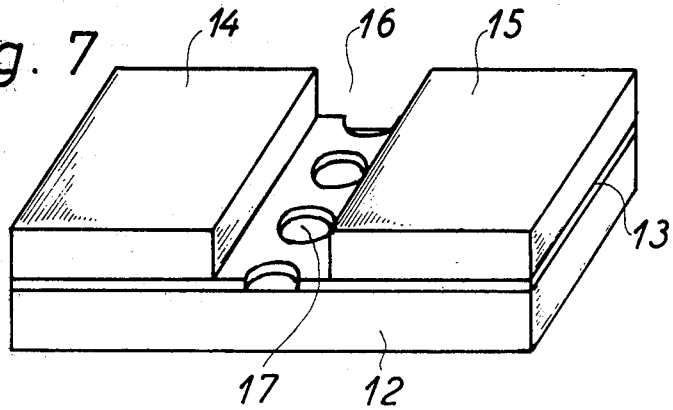

FIGS. 5, 6 and 7 show alternative fuse embodiments based on the same principle as the fuse of FIG. 4, and the corresponding parts have the same reference numbers. The figures are made in the same scale, the thickness dimensions of the fuse elements are highly exaggerated however. FIG. 5 shows a fuse element in which a reduction of the cross section of 1:16 has been obtained exclusively by means of thickness reduction. The supporting member 12 is a ceramic substrate consisting of, for instance, aluminum oxide.

FIG. 6 shows a fuse for which the same reduction ratio has been obtained by means of a combination of thickness reduction and "reduction of conductivity", i.e. by using as the layer 13 a material with higher specific electric resistance than in the layers 14 and 15. The supporting member 12 is made of the same material as in FIG. 5. The layer 13 consists of silver-platinum alloy with a specific resistance of $6.4\times10^{-8}\Omega m$, whereas the layers 14 and 15 consist of silver with a specific resistance of $1.6\times10^{-8}\Omega m$. The thickness reduction is 1:4.

Finally, FIG. 7 shows a design for which all three principles of reduction have been applied, and in this way a reduction ratio of 1:60 has been achieved, the thickness reduction being 1:4, the reduction of conductivity being 1:5, and the width reduction being 1:3, as holes 17 have been formed in the layer 13.

Figure 8:
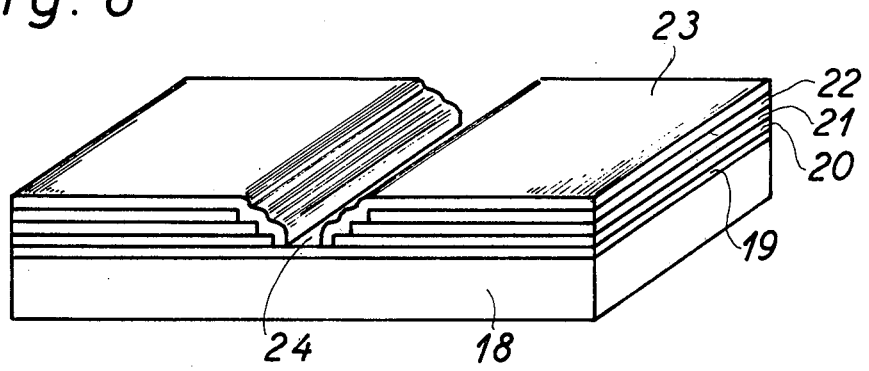

FIG. 8 shows another embodiment with a supporting member 18 upon which a layer of silver 19 has been placed. On each side of the place of break 24 three layers of copper 20, 21 and 22 have been placed, which are protected against oxidation by a covering layer 23 made of heat resisting material, such as aluminum.

Figure 9:
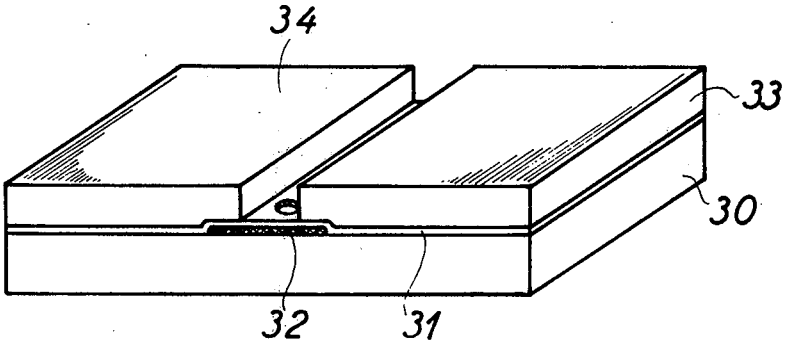

FIG. 9 shows an embodiment with a supporting element 30 on which a thin, thermally insulating layer 32 has been placed under the fusible layer 31 at the place of break. As in the previous figures, electrically conductive layers 33 and 34 have been placed on each side of the place of break. These can consist of several layers and perhaps a covering layer. In conjunction with high currents the layer 32 will delay the spreading of the heat front downwards into the supporting element 30, which will ensure that the heat generated in the place of break will cause a melting-off, and consequently the electric circuit will be opened.

Figure 10:
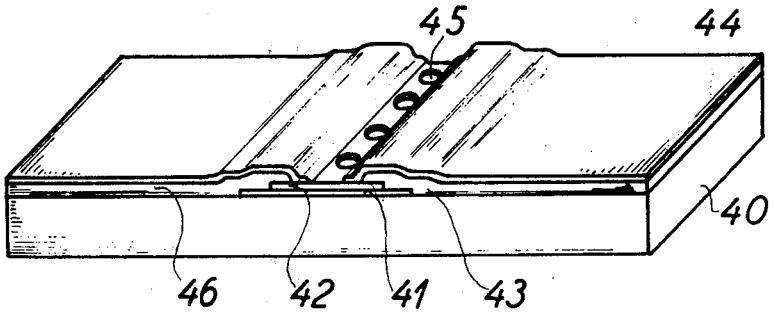

FIG. 10 shows an embodiment where all of the technical effects mentioned have been applied, as it consists of a supporting element 40 upon which a thermally insulating layer 41 has been placed, on top of this is a material 42 with a relatively low conductivity, e.g. a platinum-silver alloy with width-reducing holes 45. The layers 43 and 46 have been placed on each side of the place of break, which layers consist of a material of high conductivity, e.g. copper. For the protection of these elements a covering layer 44 has been placed on the top, which can for instance consist of aluminum or a ceramic material.

In the entire present description the invention has been explained, for the sake of convenience, as if the supporting member is always situated at the bottom, and the position of the other elements are then stated in relation to this. It is obvious, however, that the technical effect is quite independent of the position of the fuse. It is of course only the positioning of the elements in relation to each other which is significant for the technical effect.

The terms resistant material and heat resistant material, as used in the specification and claims, are understood to mean both a material which in itself is resistant to change (e.g. oxidation) under the operating conditions encountered and a material which is able to protect the underlying material.

I claim:

1. A laminated electric safety fuse of the type wherein the fuse member is surrounded by a granular arc suppression material, the fuse having an electrically insulating supporting substrate and at least one layer of electrically conductive material deposited thereon, wherein the improvement comprises:

said at least one layer of conductive material including first and second end regions contiguous to opposite ends of an intermediate break region, the electrical conductivity of said end regions being at least as high as the electrical conductivity of the break region, said substrate including at least one layer of electrically insulating material having good thermal conductivity, and the fuse further comprises a coating of heat resistant material deposited on the otherwise exposed surface of the topmost layer in at least the first and second end regions of said at least one layer of electrically conductive material for protecting said otherwise exposed surface from oxidation.

2. A safety fuse according to claim 1 wherein the heat resistant material is aluminum.

3. A safety fuse according to claim 1 wherein the resistant material is a ceramic material.

4. A safety fuse according to claim 1 wherein the heat resistant material is deposited only on the first and second end regions of the at least one layer of conductive material.

5. A safety fuse according to claim 1 wherein the break region of the at least one layer of conductive material is composed of a single layer of heat resistant material.

6. A safety fuse according to claim 5 wherein the single layer of heat resistant conductive material in the break region is a silver-platinum alloy.

7. A safety fuse according to claim 5 wherein the first and second end regions of said at least one layer of conductive material each comprises at least one layer of material having a higher conductivity than the material of said single layer in the break region.

8. A safety fuse according to claim 7 wherein the material of the at least one layer in the first and second end regions having a higher conductivity than the single layer in the break region is silver.

9. A safety fuse according to claim 7 wherein the material of the at least one layer in the first and second end regions having a higher conductivity than the single layer in the break region is copper.

* * * * *